US008328526B2

(12) United States Patent
Tanaka

(10) Patent No.: US 8,328,526 B2
(45) **Date of Patent: *Dec. 11, 2012**

(54) VACUUM CONVEYANCE SYSTEM

(75) Inventor: Shukichi Tanaka, Koganei (JP)

(73) Assignee: National Institute of Information And Communications Technology, Tokyo (JP)

( * ) Notice: Subject to any disclaimer, the term of this patent is extended or adjusted under 35 U.S.C. 154(b) by 356 days.

This patent is subject to a terminal disclaimer.

(21) Appl. No.: 12/527,194

(22) PCT Filed: Feb. 14, 2008

(86) PCT No.: PCT/JP2008/000227

§ 371 (c)(1),
(2), (4) Date: Sep. 9, 2009

(87) PCT Pub. No.: WO2008/099612

PCT Pub. Date: Aug. 21, 2008

(65) Prior Publication Data

US 2010/0098556 A1 Apr. 22, 2010

(30) Foreign Application Priority Data

Feb. 16, 2007 (JP) ..... 2007-035568
Feb. 16, 2007 (JP) ..... 2007-035570

(51) Int. Cl.
*F04B 37/02* (2006.01)
*F04F 99/00* (2009.01)

(52) U.S. Cl. ..... 417/48; 417/234

(58) Field of Classification Search ..... 417/48, 417/49, 234; 414/217; 118/719, 500
See application file for complete search history.

(56) References Cited

U.S. PATENT DOCUMENTS

| | | | | |
|---|---|---|---|---|
| 3,228,590 | A * | 1/1966 | Kearns et al. | 417/49 |
| 4,389,166 | A * | 6/1983 | Harvey et al. | 417/234 |
| 4,594,054 | A * | 6/1986 | Ishimaru et al. | 417/49 |
| 5,324,950 | A * | 6/1994 | Otaka et al. | 250/441.11 |
| 5,442,183 | A * | 8/1995 | Matsui et al. | 250/441.11 |
| 6,090,176 | A * | 7/2000 | Yoshitake et al. | 55/385.4 |
| 6,835,048 | B2 * | 12/2004 | Perkins et al. | 417/49 |
| 2004/0185586 | A1 * | 9/2004 | Yasutake et al. | 438/14 |

FOREIGN PATENT DOCUMENTS

| | | | |
|---|---|---|---|
| JP | 465057 | A | 3/1992 |
| JP | 6232238 | A | 8/1994 |
| JP | 6349928 | A | 12/1994 |
| JP | 7312202 | A | 11/1995 |
| JP | 927542 | A | 1/1997 |
| JP | 11248088 | A | 9/1999 |
| JP | 2003-222574 | A | 8/2003 |

* cited by examiner

*Primary Examiner* — Devon Kramer
*Assistant Examiner* — Ryan Gatzemeyer
(74) *Attorney, Agent, or Firm* — Pyprus Pte Ltd

(57) ABSTRACT

It is an object of the present invention to provide a portable vacuum carrying system comprising an ion pump (6) comprising a casing (1), a positive electrode (2) provided in the casing (1), a negative electrode (3) fixed to the inner wall of the casing (1) and located on the circumference of the positive electrode (2), magnets (4) placed so as to surround the circumference of the negative electrode (3), and a connection part (5) for connecting the casing (1) to other devices.

17 Claims, 17 Drawing Sheets

VACUUM CONVEYANCE SYSTEM

TECHNICAL FIELD

The present invention relates to a vacuum carrying system using an ion pump device etc. so miniaturized as to be carried by introducing three-dimensional magnetic fields.

BACKGROUND ART

With the development of nanotechnology and ultra-precision measuring technologies, ultrahigh vacuum technologies have been emphasized. Surfaces of semiconductors are subject to pollution by gas molecules. In contrast, by maintaining semiconductors in an ultrahigh vacuum below about $10^{-7}$ Pa, the surfaces of semiconductors can be kept clean. And pumps such as an ion pump are used to maintain an ultrahigh vacuum.

As shown in FIGS. 4(A) and 4(B) in Japanese Patent Application Laid-Open No. H9-27294, for example, conventional ion pumps have arranged tabular permanent magnets so as to face each other in parallel across a cuboid container. For this reason, the magnetic fields are unidirectional, and the spaces in the ion pumps have not been able to be effectively utilized.

In order to solve such a problem, an ion pump comprising a cylindrical positive electrode and a cylindrical negative electrode in its circumference both arranged concentrically in a cylindrical casing, characterized in that a radial electric field generation means among each cylindrical surface of the said cylindrical negative electrode, the cylindrical positive electrode and the casing, and a magnetic field generation means parallel to the axis of the said cylindrical positive electrode and the cylindrical negative electrode are provided in the cylindrical casing" is disclosed in claim 1 in Japanese Patent Application Laid-Open No. H9-27294 (see Patent Document 1 below).

Furthermore, "a sputter ion pump comprising an anode electrode and a cathode electrode arranged in a vacuum chamber, wherein high voltage is applied between the anode electrode and cathode electrode so that electrons are spirally moved by means of a magnetic field, residual gas molecules are collided with electrons that are spirally moving and are ionized, and the ionized molecules sputter the cathode electrode to adsorb onto the surfaces of the anode electrode or the like, thereby performing an evacuation, characterized in that the cylindrical section of the vacuum chamber wall is formed to have a convex or concave cross-sectional profile, permanent magnets each having the same shape and character are located in the direction of the same magnetic pole in each concave portion outside the convex or concave cross-sectional profile, anode electrodes each of which is cylindrical are located apart from the vacuum chamber wall in each concave portion inside the convex or concave cross-sectional profile, the cylindrical portion of the vacuum chamber wall is constituted as a cathode electrode, a cylindrical magnetic shield member equipped with an exhaust hole circumferentially is arranged concentrically with the plurality of permanent magnets and the anode electrodes, and the plurality of permanent magnets and the anode electrodes are arranged at equal intervals axially opposite one another.

However, such ion pumps need to use many insulators such as ceramics in order to obtain insulation between electrodes. For this reason, there is a problem that gases are emitted from ceramics etc., lowering a degree of vacuum. There is also a problem that such ion pumps do not have enough intensity.

Furthermore, such ion pumps are large and heavy, and their power consumption is also large. Therefore, there is a problem that once the conventional ion pumps are located they cannot be moved easily. Consequently, a vacuum carrying system is desired which can activate an ion pump and carry samples while maintaining the atmosphere where the samples are placed in a vacuum.

In general, vacuum devices are stationary and manufactured to order. Some are provided with a sample stand for loading samples in a vacuum chamber. Sample stands vary by manufacturer. Therefore, there arises a problem that, even if a vacuum carrying system is developed, it cannot deliver the carried samples to sample stands of a variety of vacuum chambers.

[Patent Document 1] Japanese Patent Application Laid-Open No. H9-27294

[Patent Document 2] Japanese Patent Application Laid-Open No. 2001-332209

DISCLOSURE OF THE INVENTION

It is an object of the present invention to provide a portable vacuum carrying system.

It is an object of the present invention to provide a portable vacuum carrying system which can deliver samples among a variety of vacuum chambers.

The present invention is basically based on a knowledge that, by using a casing of an ion pump as a negative electrode and arranging in its circumference a plurality of ring-like magnets in series, three-dimensional magnetic fields can be obtained and miniaturization can also be attained. Furthermore, the present invention is based on a knowledge that by using such an ion pump a portable carrying system which can maintain a sample room in a vacuum can be obtained.

The first aspect of the present invention relates to a vacuum carrying system (22). The system comprises a sample room (11) for storing samples and an ion pump (6) for creating a vacuum in the inside of the sample room (11). And the sample room (11) comprises a gate part (14) for connecting with other device and a connection part (15) for connecting with the ion pump (6). The ion pump comprises a casing (1), a first electrode (2), a second electrode (3), magnets (4), and a connection part (5). And the first electrode (2) is provided inside the casing (1). The second electrode (3) is fixed on the inner wall of the casing (1) and located in the circumference of the first electrode (2). The second electrode (3) has a different polarity from that of the first electrode (1). The magnets (4) are located so as to surround the circumference of the second electrode (3). The connection part (5) comprises a mechanism for connecting the casing (1) with other device.

By using this vacuum carrying system, a sample room and an ion pump can be carried with them stored in a storage case and thus the samples stored in the sample room cane be carried easily while they are in a vacuum environment.

The desirable mode of the first aspect of the present invention further comprises a storage case (21). The storage case stores a sample room (11) and an ion pump (6). The storage case (21) comprises a frame (23) of the storage case and a storage part (24). The storage part (24) is provided inside the frame (23). The storage part (24) comprises voids equivalent to the shapes of the sample room and the ion pump. And the sample room and the ion pump can be located in the voids.

An ion pump is connected with the vacuum carrying system of the present invention. Therefore, it would not generally be supposed that the vacuum carrying system could be carried stored in an attaché case etc. However, the vacuum carrying system of the present invention can be miniaturized. Therefore, the system of this mode can be carried with a sample room and an ion pump stored in a storage case (21), thereby allowing easy carriage while maintaining the sample room in a vacuum.

In the desirable mode of the first aspect of the present invention, an ion pump comprising a casing (1), a first electrode (2), a second electrode (3), a plurality of cylindrical magnets (4), and a connection part (5). And the first electrode (2) is provided inside the casing (1). The second electrode (3) is fixed on the inner wall of the casing (1). Also the second electrode (3) is located in the circumference of the first electrode (2). And the first electrode and the second electrode have different polarities. The cylindrical magnets (4) are located so as to surround the circumference of the second electrode (3). The magnets may be located outside the casing (1). The connection part (5) is a mechanism for connecting the casing (1) with other device. The plurality of cylindrical magnets (4) are located so as to surround the circumference of the second electrode (3). The plurality of cylindrical magnets (4) are located in a row at intervals in the central axis direction of the casing (1).

The ion pump fixes the second electrode (e.g., negative electrode) to the inner wall of the casing, and locates the second electrode in the circumference of the first electrode (e.g., positive electrode). And the ion pump locates a plurality of cylindrical magnets (4) so as to surround the circumference of the second electrode (3). In this way, three-dimensional magnetic fields can be obtained and ion pumps can be miniaturized as well. In an example of a preferred ion pump, the inner wall or the side wall of the casing concurrently serves as the second electrode. In this way, ion pumps can be miniaturized further. As an ion pump of the present invention is preferably portable, it is preferred to use batteries as a power supply. The DC voltage from batteries can be converted, using a converter suitably, to further high-voltage DC voltage or AC voltage for use.

In the present invention, the cylindrical magnets (4) are preferably a plurality of cylindrical magnets located in a row at intervals in the central axis direction of the casing.

Magnets are generally heavy in weight. The ion pump of this mode, instead of using one cylindrical magnet, divides it into a plurality of cylindrical magnets and locates them at predetermined intervals. This can make the ion pump more lightweight and efficient magnetic fields can be obtained as well. Moreover, by using a plurality of small magnets easy to process instead of a large magnet hard to process, the difficulty in processing the shape or size of the pump casing is significantly improved.

The desirable mode of the first aspect of the present invention has a movement mechanism of magnets. The movement mechanism (14) moves the plurality of cylindrical magnets in the longitudinal direction of the casing (1). The movement mechanism (14) can change the region where magnetic fields concentrate. This can prevent the degradation of the system as well as improve the efficiency of the system. This configuration can be employed in any ion pump explained earlier. The movement mechanism may move magnets manually.

The desirable mode of the first aspect of the present invention relates to the cylindrical magnets which are removable from the casing (1). This ability to remove the cylindrical magnets improves productivity and makes maintenance easier.

The desirable mode of the first aspect of the present invention is configured so that adjacent surfaces of the plurality of cylindrical magnets have the same polarities. Further magnetic materials may be inserted between the adjacent magnets. The magnetic materials are arranged so that the magnetic fields going from the adjacent surfaces into the central axis direction of the casing (1) may be stronger. In this way, as the magnetic materials are located between the adjacent magnets, the spatial distribution of magnetic flux can be adjusted and the magnetic flux penetration into the electromagnetic direction can be promoted. These magnetic materials include a permanent magnet, an electromagnet, soft iron, iron, a ferrite, and the like, which have magnetic flux rectification effects. This configuration can be employed in any ion pump explained earlier.

This further arrangement of magnetic materials between magnets can strengthen the magnetic fields formed in the casing. This can improve the efficiency of the system.

In the desirable mode of the first aspect of the present invention, the casing (1) is the second electrode (3). That is, the desirable ion pump used for the present invention uses the casing itself as the second electrode (3). More specifically, the ion pump uses the casing made of aluminum with titanium evaporated on the surface. The casing serves as the second electrode (3). This configuration can be employed in any ion pump explained earlier. This can make the ion pump more lightweight and also make it more miniaturized with the structure simpler.

In the desirable mode of the first aspect of the present invention, each element comprising an ion pump is rod-like or cylindrical. That is, the casing (1) is cylindrical. And the first electrode (2) is a rod-like electrode located on the central axis of the casing or a cylindrical electrode located concentrically to the casing. The second electrode (3) is a cylindrical electrode located concentrically to the casing. The cylindrical magnets (4), located concentrically to the casing, are cylindrical. This configuration can be employed in any ion pump explained earlier.

In this way, as each element is arranged concentrically, it is possible to generate ion etc. efficiently to trap gases.

The desirable mode of the first aspect of the present invention relates to an ion pump wherein one end of the first electrode (2) is fixed to the casing. This configuration can be employed in any ion pump explained before.

A common ion pump etc. use many ceramics etc. to insulate the second electrode from the first electrode. This mode of ion pump, as it fixes the first electrode to the casing, can effectively prevent the situation where the first electrode swings and contacts the second electrode while the ion pump is in operation. Therefore, it reduces the need of using many insulators such as a ceramics and can effectively increase the degree of vacuum.

In the desirable mode of the first aspect of the present invention, one end of the first electrode (2) is fixed to the casing. And a spacer (8) is located in the opposite region to the one end fixed to the casing. The spacer fixes the first electrode (2) to the casing. This configuration can be employed in any ion pump explained earlier.

A common ion pump etc. use many ceramics etc. as an insulation to insulate the second electrode from the first electrode. This mode of ion pump, as it fixes the first electrode to the casing, can effectively prevent the situation where the first electrode swings and contacts the second electrode while the ion pump is in operation. Therefore, it reduces the need of using many insulators such as a ceramics and can effectively increase the degree of vacuum. Furthermore, the first electrode is more firmly fixed by the spacer, which can further effectively prevent the situation where the first electrode swings and contacts the second electrode even while the ion pump is in operation.

The desirable mode of the first aspect of the present invention is a vacuum carrying system (22) as described in any of the above, wherein the sample room (11) comprises a sample substrate (41) for loading samples and the sample substrate (41) has a plurality of sample installation stages (42) in line in the longitudinal direction of the sample room (11) for loading a plurality kinds of sample stands (43).

Thus, as the vacuum carrying system has a sample substrate (41) comprising the sample installation stages (42) for loading a plurality kinds of sample stands (43), the carried samples can be used in new vacuum chambers even if sample stands vary by vacuum chamber.

The desirable mode of the first aspect of the present invention is a vacuum carrying system (22) as described in any of the above, wherein the sample substrate (41) comprises a sample stand arrangement/transfer part for arranging the plurality kinds of sample stands (43) in piles and a fixation mechanism for fixing the plurality of sample stands (43) arranged in piles by the sample stand arrangement/transfer part.

In this way, the ability to arrange sample stands in piles allows carriage of samples to a plurality kinds of vacuum chambers.

In the desirable mode of the first aspect of the present invention, a sample room (11) comprises a drive mechanism (51) for driving a sample substrate (41). And the drive mechanism can move the sample substrate (41) from the inside to the outside of the sample room (11). Moreover, the drive mechanism can move the sample substrate (41) from the outside to the inside of the sample room (11) as well. Preferable, the drive mechanism (51) is a magnet coupling drive mechanism.

The system having such a drive mechanism can easily move a sample substrate from the inside to the outside of a sample room as well as move a sample substrate from the outside to the inside of a sample room.

According to the present invention, a portable vacuum carrying system is provided.

According to the present invention, a portable vacuum carrying system is provided which allows delivery of samples in a variety of vacuum chambers.

BRIEF DESCRIPTION OF THE DRAWINGS

FIG. 1(*a*) shows a sectional view of an ion pump wherein a casing concurrently serves as a second electrode. FIG. 1(*b*) shows a sectional view of an ion pump wherein a caging (1), cylindrical magnets (4), and a second electrode (3) are located in order from the external surface. FIG. 1(*c*) shows a sectional view of an ion pump wherein the caging has the portions in convex or concave shape for storing magnets where the magnets are located.

FIG. 8(*a*) shows a rear view and FIG. 8(*b*) shows a side view.

FIG. 10(*a*) shows a sample substrate wherein each sample stand is loaded on respective sample installation stages, whereas FIG. 10(*b*) shows a sample substrate wherein one of the sample stands is loaded on other sample stand. FIG. 10(*c*) shows the fixed sample stands in piles.

FIG. 11(*a*) shows the situation of a shortened movement axis, whereas FIG. 11(*b*) shows the situation of an extended movement axis.

DESCRIPTION OF THE NUMERALS

Figure 1A:
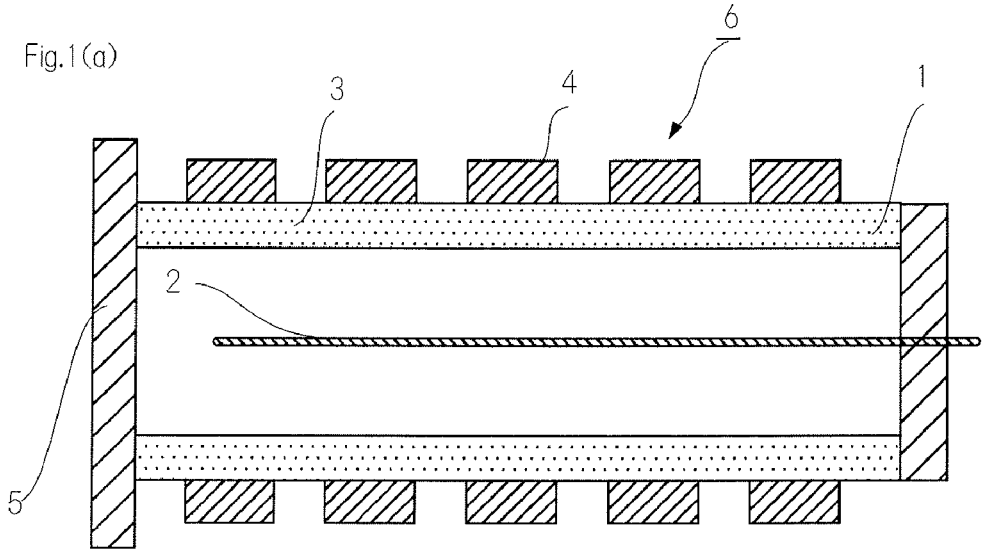
FIG. 1 shows a schematic view for explaining an ion pump used for the present invention.

1 Casing
2 Positive electrode
3 Negative electrode
4 Magnets
5 Connection
6 Ion pump

BEST MODE OF CARRYING OUT THE INVENTION

Hereinafter, the best mode of carrying out the present invention will be described. A vacuum carrying system of the present invention is a portable vacuum carrying system comprising a sample room (11) for storing samples, an ion pump (6) for creating a vacuum in the inside of the sample room, and a storage case (21) for storing the sample room and the ion pump.

1. Ion Pump

Figure 1B:
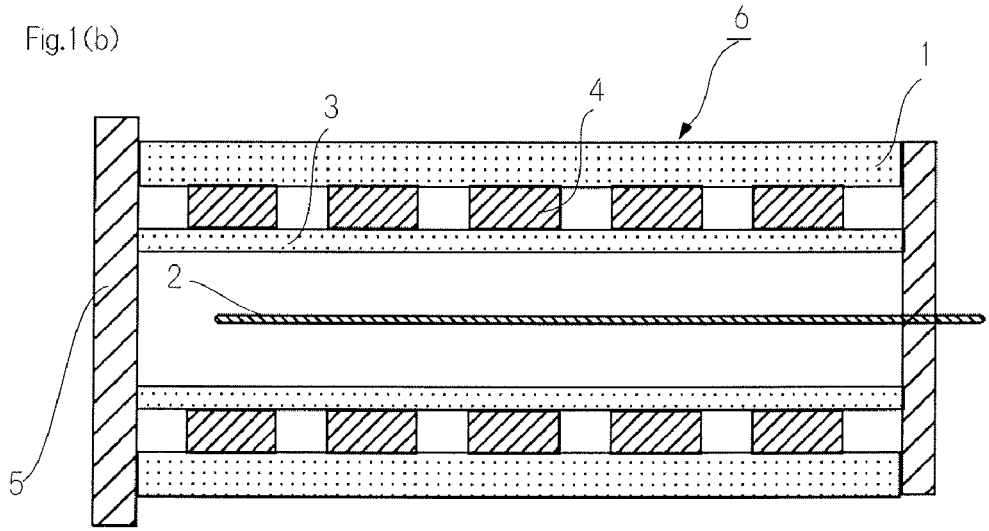
Figure 1C:
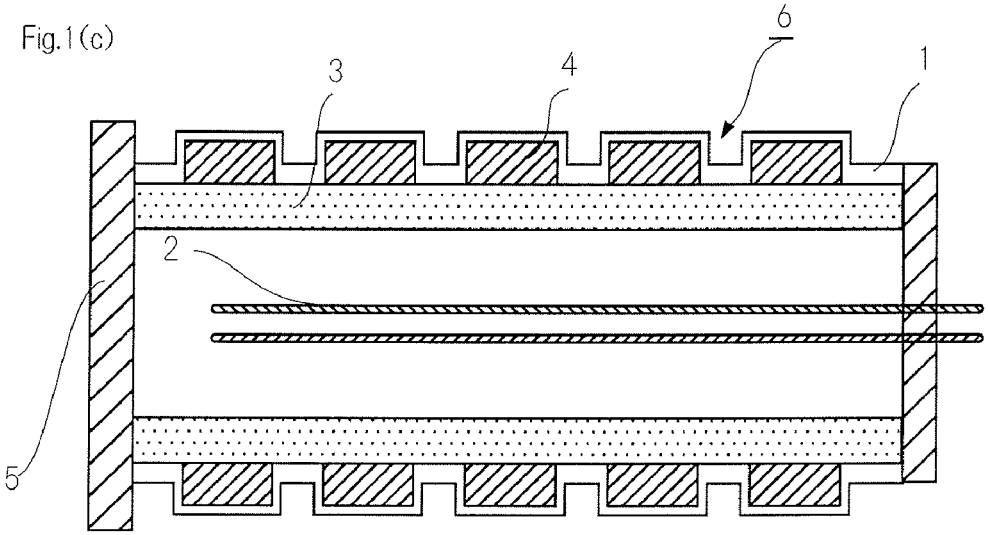

FIG. 1 shows a schematic view for explaining an ion pump of the present invention. FIG. 1(*a*) shows a sectional view of the ion pump wherein a casing concurrently serves as a second electrode. FIG. 1(*b*) shows a sectional view of an ion pump wherein a caging (1), cylindrical magnets (4), and a second electrode (3) are located in order from the external surface. FIG. 1(*c*) shows a sectional view of an ion pump wherein the caging has the portions in convex or concave shape for storing magnets where the magnets are located. As shown in FIG. 1, an ion pump concerning the first aspect of the present invention relates to an ion pump comprising a casing (1), a first electrode (2), a second electrode (3), a plurality of cylindrical magnets (4), and a connection part (5). The first electrode (2) is provided inside the casing (1). The second electrode (3) is fixed on the inner wall of the casing (1). Also the second electrode (3) is located in the circumference of the first electrode (2). And the first electrode and the second electrode have different polarities. That is, one of the first electrode and the second electrode is a positive electrode and the other is a negative electrode. The cylindrical magnets (4) are located so as to surround the circumference of the second electrode (3). The magnets may be located outside the casing (1). The connection part (5) is a mechanism for connecting the casing (1) with other device.

The ion pump fixes the second electrode to the inner wall of the casing. Also the ion pump locates the second electrode in the circumference of the first electrode. Furthermore, the cylindrical magnets (4) surround the circumference of the second electrode (3). In this way, the ion pump can obtain three-dimensional magnetic fields and can be miniaturized as well. In case of a desirable ion pump, the inner wall or the side wall of the casing concurrently serves as the second electrode. Preferably, an ion pump of the present invention is portable. Thus it is preferred to use batteries as a power supply. The DC voltage from batteries can be converted, using a converter suitably, to further high-voltage DC voltage or AC voltage for use.

In a desirable ion pump of the present invention, the casing (1) is cylindrical. And the first electrode (1) is a rod-like electrode located on the central axis of the casing or a cylindrical electrode located concentrically to the casing. The second electrode (3) is a cylindrical electrode located concentrically to the casing. The cylindrical magnets (4), located concentrically to the casing, are cylindrical. Thus, as each element is arranged concentrically, it is possible to generate ion etc. efficiently to trap gases. Hereinafter, each element constituting the ion pump of the present invention will be explained.

Casing (1)

A casing is a frame of an ion pump. A variety of electrodes etc. can be formed inside the frame. Though magnets are usually located inside the casing, they may be located outside the casing. Well-known materials such as aluminum, titanium, stainless steel, or the like can be used as a material of the casing. Among these, aluminum with titanium evaporated on the surface is desirable. In case of the casing made of aluminum with titanium evaporated on the surface, the inner wall itself of the casing can be used as the second electrode. This can make the ion pump more lightweight and also make it more miniaturized with the structure simpler. In contrast, the second electrode and the casing may be located concurrently, a plurality of magnets may be located in the space between them, and a second electrode fixation part for connecting the second electrode with the casing may be located between the plurality of magnets, for example. Then, the second electrode can effectively be fixed with the casing.

First Electrode (2)

Well-known materials can suitably be employed as a material used for the first electrode. Preferably, the first electrode (1) is a rod-like electrode located on the central axis of the casing or a cylindrical electrode located concentrically to the casing. The first electrode is a positive electrode, for example. However, it may be a negative electrode. The desirable mode of the present invention comprises a polarity control device which can change the polarity of the first electrode.

Figure 2:
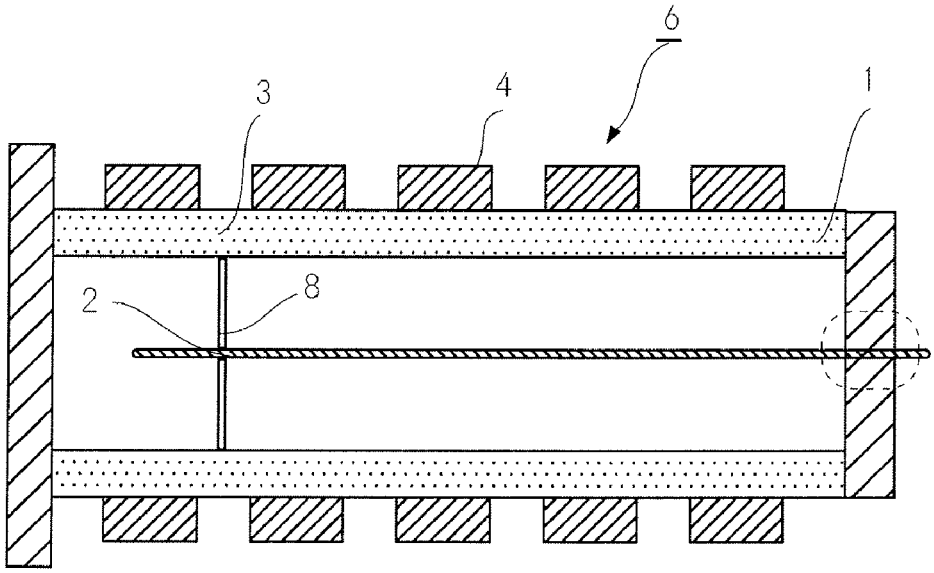
FIG. 2 shows the situation of a first electrode in an ion pump.

FIG. 2 shows the status of the first electrode in the ion pump. As shown in FIG. 2, in a desirable ion pump, one end of the first electrode (2) is fixed to the casing (1). In FIG. 2, the one end of the first electrode is fixed to the end surface of the casing in the region shown by a dotted line. And, a spacer (8) is located in the region of the first electrode (2) opposite to the one end fixed to the casing. The first electrode is fixed to the casing through the spacer. The spacer for fixing the first electrode (2) to the casing is for fixing the portion not fixed to the casing of the first electrode with the casing or the second electrode. This can prevent the end of the first electrode from swinging. Specific spacers include a plurality of linear spacers extending from the first electrode to the second electrode or the casing, like a spoke of wheel supposing that the first electrode is a hub.

A common ion pump uses a ceramics etc. to insulate the second electrode and the first electrode. The desirable ion pump of the present invention fixes the first electrode to the casing. This can effectively prevent the situation where the first electrode swings and contacts the second electrode even if external vibration, shock etc. are caused while the ion pump is in operation. Therefore, it reduces the need of using insulators such as a ceramics and can effectively increase the vacuum. Furthermore, as the first electrode is fixed further strongly by the spacer, the ion pump can effectively prevent the situation where the first electrode swings and contacts the second electrode while the ion pump is in operation.

A common ion pump uses a ceramics etc. to insulate the second electrode from the first electrode. The desirable ion pump of the present invention fixes the first electrode to the casing. In this way, the ion pump of the present invention can effectively prevent the situation where the first electrode swings and contacts the second electrode while the ion pump is in operation. Therefore, it reduces the need of using many insulators such as a ceramics and can effectively increase the degree of vacuum. Furthermore, the first electrode is more firmly fixed by the spacer, which can effectively prevent the situation where the first electrode swings and contacts the second electrode even while the ion pump is in operation.

Second Electrode (3)

Well-known materials can suitably be employed as a material used for the first electrode. Preferably, the second electrode (3) is a cylindrical electrode located concentrically to the casing. The second electrode has a different polarity from the first electrode. That is, if the first electrode is positive, the second electrode is negative.

Cylindrical Magnets (4)

In the present invention, a plurality of cylindrical magnets are used which are located in a row at intervals in the central axis direction of the casing. In the present invention, it is preferred to use a plurality of ring-like permanent magnets in a row. Preferably, each of these ring-like permanent magnets has the same width. Also, the ring-like permanent magnets are preferably arranged at equal intervals. The ion pump of this mode, instead of using one cylindrical magnet, divides it into a plurality of cylindrical magnets and locates them at predetermined spaces, which can make the ion pump more lightweight and efficient magnetic fields can be obtained as well. Electromagnets can be used instead of the permanent magnets.

Figure 3:
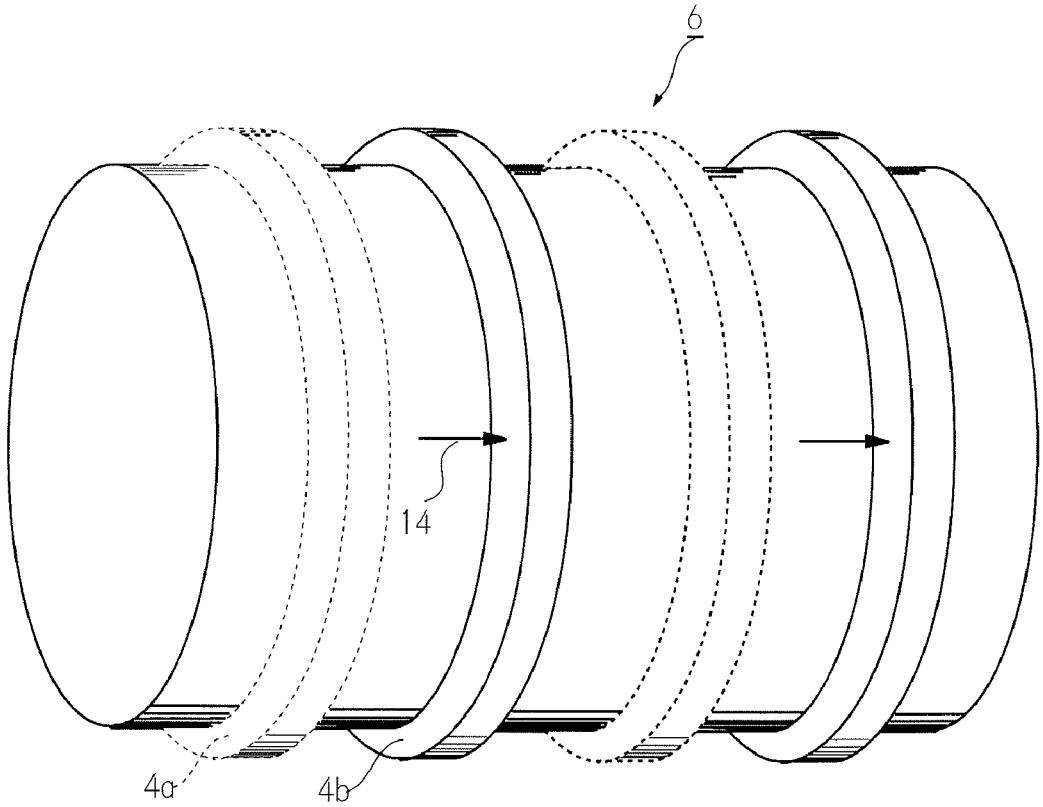
FIG. 3 shows a conceptual diagram of an ion pump having a movement mechanism.

The desirable mode of the first aspect of the present invention relates to any ion pump as described above, which further has a movement mechanism (14) moving a plurality of cylindrical magnets in the longitudinal direction of the casing (1), as shown in FIG. 3. This movement mechanism (14) can change the region where the magnetic fields concentrate, which can prevent the degradation of the system as well as improve the efficiency of the system. The movement mechanism may move magnets manually.

The desirable mode of the first aspect of the present invention relates to the cylindrical magnets which are removable from the casing (1). This ability to remove the cylindrical magnets improves productivity and makes maintenance easier.

FIG. 3 shows a conceptual diagram of an ion pump having a movement mechanism. That is, the ion pump of this mode has a movement mechanism for moving magnets from the location where magnetic fields are strong to the location where magnetic fields are weak. This can move magnets from the pre-movement state (4*a*) to post-movement state (4*b*). More specifically, the plurality of cylindrical magnets are united and are located so that they can slide in advance. And an actuator is connected to the plurality of cylindrical magnets. The actuator is connected to a control part. And the control part instructs the actuator to move the cylindrical magnets. Then, the actuator moves the cylindrical magnets by a predetermined amount. As a result, the cylindrical magnets can be moved by a predetermined amount.

Figure 4:
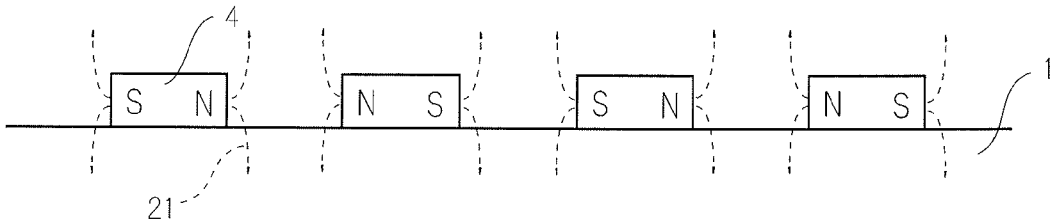
FIG. 4 shows a conceptual diagram showing the magnetic fields with external magnets in an ion pump having the fixed external magnets.

FIG. 4 shows a conceptual diagram showing the magnetic fields with external magnets in an ion pump having the fixed external magnets. The magnetic fields are denoted by numeral 21 in the figure. As shown in the FIG. 4, when the external magnets are fixed, the magnetic fields begin to leak not only to the internal of the casing but to the external of the casing.

Figure 5:
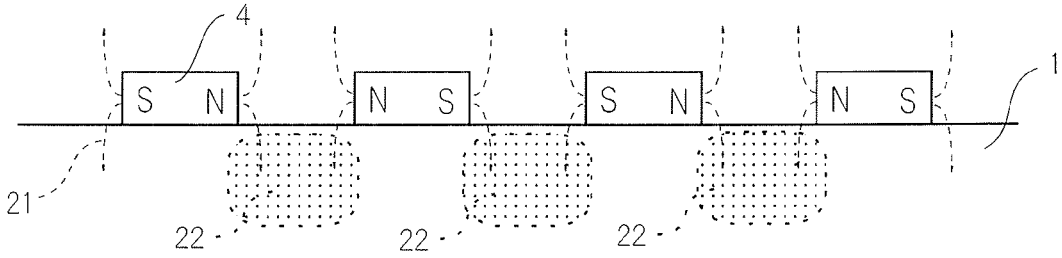
FIG. 5 shows a conceptual diagram showing the portions where magnetic fields with external magnets concentrate in an ion pump having the fixed external magnets.

FIG. 5 shows a conceptual diagram showing the portions where magnetic fields with external magnets concentrate in an ion pump having the fixed external magnets. As shown in FIG. 5, in an ion pump having fixed external magnets, magnetic fields concentrates on the portions denoted by numeral 22. That is, in an ion pump having fixed external magnets, getter surfaces concentrate and thus vacuum efficiency degrade earlier. Furthermore, as getter surfaces concentrate, this ion pump can deteriorate earlier.

Figure 6:
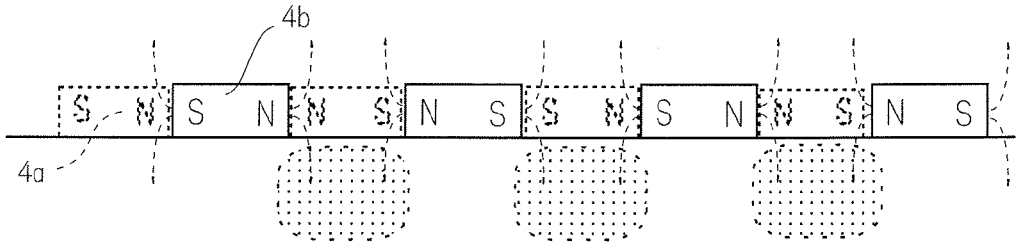
FIG. 6 shows a conceptual diagram showing the magnetic fields with external magnets after moving magnets using a movement mechanism.

FIG. 6 shows a conceptual diagram showing magnetic fields with external magnets after moving magnets using a movement mechanism. As shown in FIG. 6, the use of a movement mechanism can shift the location where magnetic fields concentrate. This enables molecules to be adsorbed to the surfaces where molecules are not adsorbed, which can improve adsorption efficiency. As explained earlier, an example of the movement mechanism applies a force to the permanent magnets—a plurality of cylindrical magnets connected together—using an actuator, and changes the locations of the plurality of cylindrical magnets.

The desirable mode of the first aspect of the present invention is configured so that the adjacent surfaces of the plurality of cylindrical magnets have the same polarities. And the ion pump of this mode further comprises magnetic materials between the adjacent magnets of the plurality of cylindrical magnets. The magnetic materials are arranged so that the magnetic fields going from the adjacent surfaces into the central axis direction of the casing (1) may be stronger. In this way, as the magnetic materials are located between the adjacent magnets, the spatial distribution of magnetic flux can be adjusted and the magnetic flux penetration into the electromagnetic direction can be promoted. These magnetic materials include a permanent magnet, an electromagnet, soft iron, iron, a ferrite, and the like, which have magnetic flux rectification effects.

Figure 7:
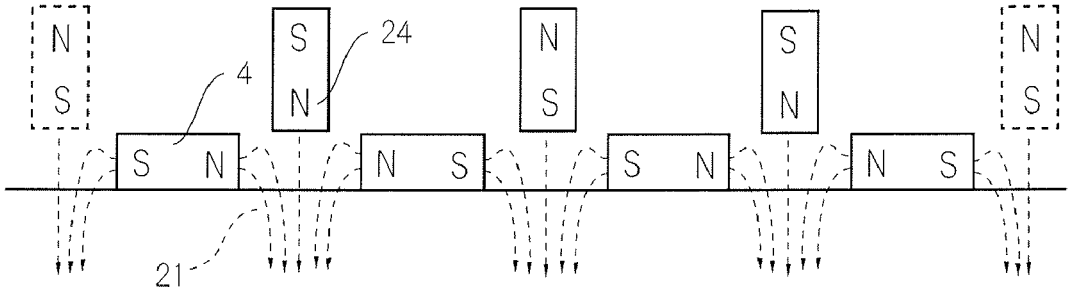
FIG. 7 shows a conceptual diagram showing magnetic fields with external magnets in an ion pump including magnetic materials between the adjacent magnets.

FIG. 7 shows a conceptual diagram showing magnetic fields with external magnets in an ion pump including magnetic materials between the adjacent magnets. In FIG. 7, magnets are used as an example of magnetic materials. As shown in FIG. 7, this ion pump can more strengthen the magnetic fields formed in the casing by arranging further magnets between external cylindrical magnets (4). This can improve the system efficiency. The magnets arranged between the magnets may be cylindrical magnets.

For example, if the adjacent cylindrical magnets (4) are arranged turning N poles to each other, magnet fields of N poles are formed between the cylindrical magnets. Next, further magnets are located between and above these adjacent cylindrical magnets. The magnets (24) between the cylindrical magnets are located so that their lower sides turn to N pole. In this way, the magnetic fields with N poles formed by the adjacent cylindrical magnets (4) can be strengthened. Preferably, the magnets between the cylindrical magnets are also cylindrical or ring-like. Preferably, the ring-like magnets are located between the adjacent cylindrical magnets and also have a larger diameter than that of the cylindrical magnets.

Connection Part (5)

A connection part (5) is a portion for connecting a casing with other device. "Other device" includes a vacuum chamber, a sample room, etc. in which a vacuum state is to be created. A specific connection part (5) is a flange.

Ion Pump (6)

The operating principle of an ion pump is well-known. The operating principle of an ion pump is briefly explained below. When the voltage of about several kilovolts is applied to and between a second electrode and a first electrode of an ion pump, primary electrons are emitted from the second electrode. As the primary electrons emitted from the second electrode are drawn to the first electrode and yet are influenced by the magnetic fields from permanent magnets, they circle following a long spiral path to reach the first electrode. On the way, the primary electrons cause ionization crashes with neutral gas molecules, and generate many positive ions and secondary electrons. The generated secondary electrons further follow a spiral path, cause crashes with other gas molecules, and generate positive ions and electrons. Then the ions etc. are adsorbed to the electrode.

The ion pumps concerning the present invention can suitably use the well-known configurations used for ion pumps in addition to the above. For example, a heater, a cooler, etc. may be attached suitably. Cooling with a cooler can improve the repairing efficiency of gasses. In contrast, heating with a heater can maintain a vacuum state and emit the gasses trapped by the electrode.

2. Vacuum Carrying Device

Figure 8A:
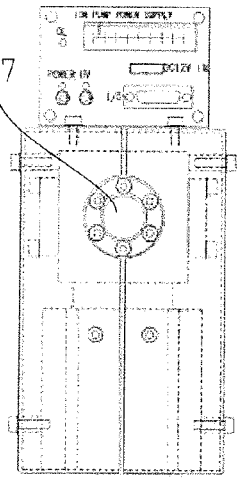
FIG. 8 shows a conceptual diagram for explaining a vacuum carrying device of the present invention.
Figure 8B:
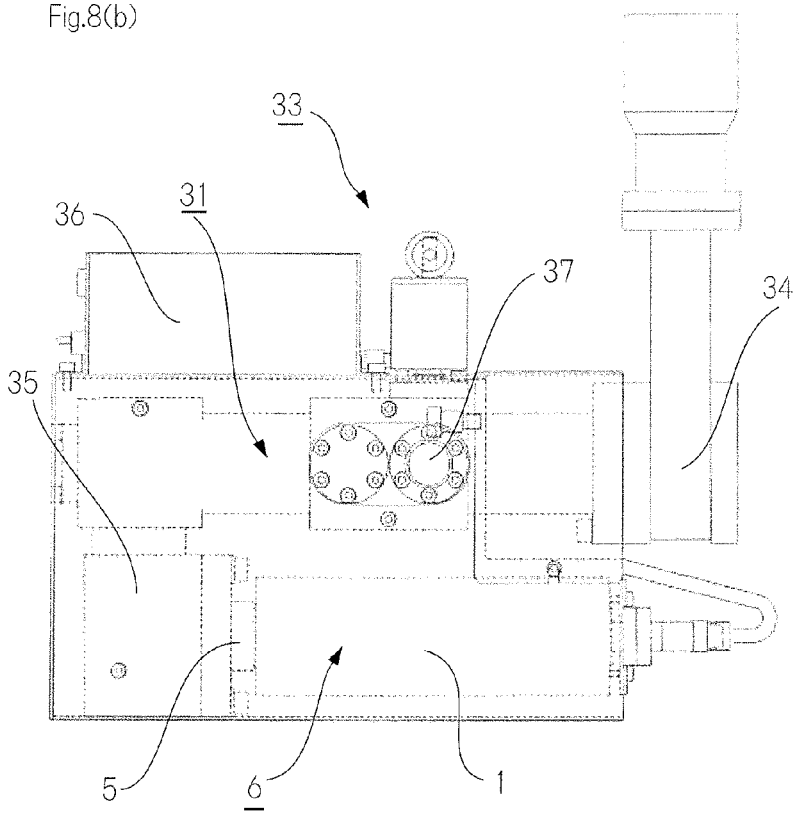

FIG. 8 shows a conceptual diagram for explaining a vacuum carrying device of the present invention. FIG. 8(*a*) shows a rear view and FIG. 8(*b*) shows a side view. As shown in FIG. 8, the vacuum carrying device (33) concerning the second aspect of the present invention comprises a sample room (31) and an ion pump (6). The sample room (31) comprises a gate part (34) into and from which samples are carried and which can also be connected to other device, and a connection part (35) for connecting with the ion pump. And any ion pump as explained earlier can suitably be used as the ion pump (6). In the figure, numeral 36 refers to a power supply (battery) and numeral 37 refers to a viewport.

By using this vacuum carrying device, the samples stored in the sample room can be carried while in a vacuum environment. That is, "a portable vacuum carrying device" means a carrying device which can be moved while an ion pump is in operation. The ion pumps of the first aspect and those apparent from them can be used suitably as an ion pump in the vacuum carrying device. The use of such efficient and miniaturized ion pumps allows reduction in weight of the vacuum carrying device of the present invention.

A sample stand, for example, is located in the sample room (31) and samples are fixed to it. Alternatively, sample may be moved. And the atmosphere where the samples are located is maintained in a vacuum state by an ion pump. The sample room is a vacuum chamber etc. A gate part (34) is a gate valve, for example. This allows maintenance of a vacuum state and opening/closing of the sample room, and, in addition, connection to other vacuum device while maintaining the vacuum state in the sample room. A connection part (35) is not specifically limited as far as it can connect the sample room with an ion pump while maintaining the vacuum state in the sample room. Well-known batteries can be used suitably as a power supply (36). Although a viewport (37) is arbitrary, the inside of the chamber can be seen through the viewport. Moreover, observations/experiments can be conducted using the viewport (37). Furthermore, by locating a feed-through (current introduction terminal), resistance measurements can be conducted and samples can be heated as well.

Though not particularly illustrated, an opening may be located between ring-like magnets, and the opening may be connected with other target systems such as a vacuum chamber etc. in which a vacuum is to be created, and these plurality of target systems may be maintained in a vacuum state. The introduction of such a configuration enables a plurality of targets to be easily maintained in a vacuum. Such a system can be used more effectively, particularly when a plurality of targets are carried that do not need to be maintained in an ultrahigh-vacuum.

Figure 9:
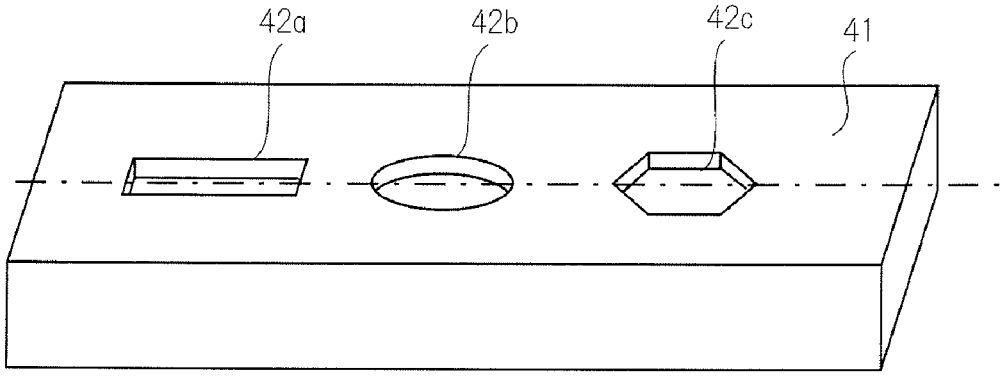
FIG. 9 is a photograph replacing a drawing showing the actually manufactured vacuum carrying device.

FIG. 9 is a conceptual diagram showing the example of a sample substrate. As shown in FIG. 9, a desirable sample substrate (41) has a plurality of sample installation stages (42) in line in the longitudinal direction of a sample room (11). The sample installation stages (42*a*, 42*b*, 42*c*) are for loading sample stands. As shown in FIG. 9, the sample installation stages (42), for example, can be formed depending on the dents matched with the shapes of the sample stands. Then, if the sample stands corresponding to the sample installation stages (42) are located on the sample installation stages (42), they will get into the dents. In this way, the sample stands are fixed. Thereby, the situation can be effectively prevented where the sample stands are moved when samples are carried.

Thus as the sample substrate (41) comprises the sample installation stages (42) for loading a plurality kinds of sample stands, even if the sample stands vary by vacuum chamber, the carried samples can be used in new vacuum chambers.

Figure 10A:
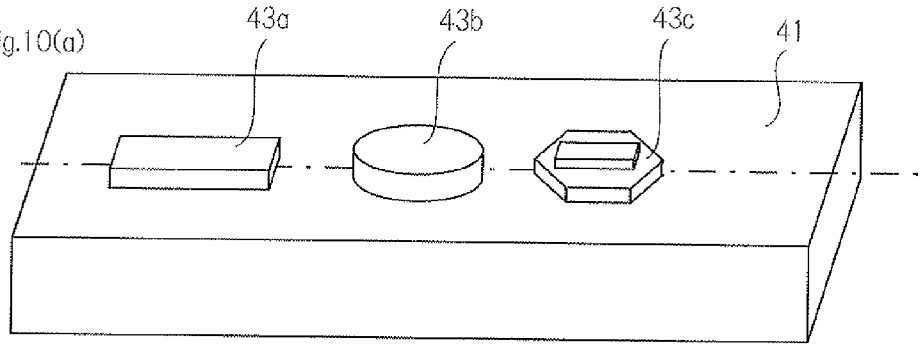
FIG. 10 shows an example of a sample substrate whereon samples are loaded.
Figure 10B:
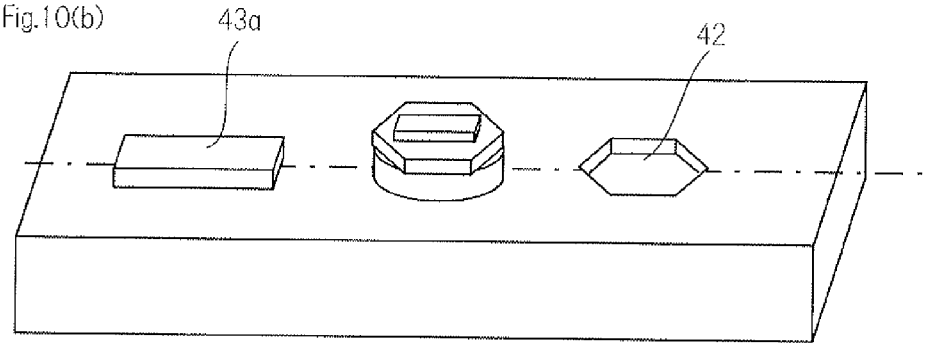
Figure 10C:
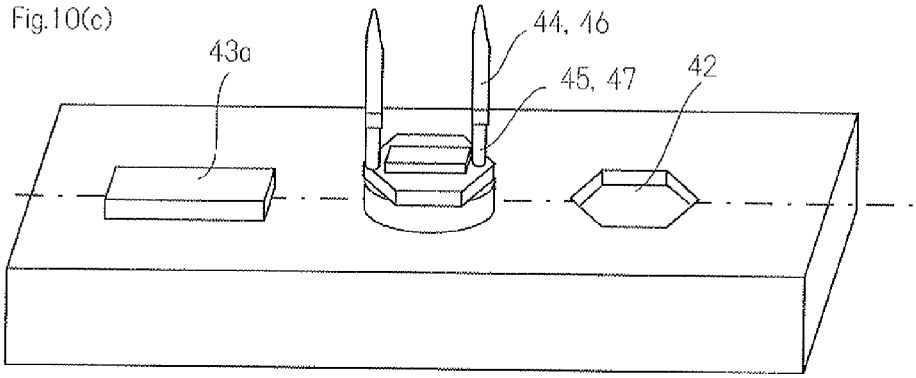

FIG. 10 shows an example of a sample substrate whereon samples are loaded. FIG. 10(*a*) shows a sample substrate wherein each sample stand is loaded on respective sample installation stages, whereas FIG. 10(*b*) shows a sample substrate wherein one of the sample stands is loaded on other sample stand. FIG. 10(*c*) shows the fixed sample stands in piles. As shown in FIG. 10, in the desirable mode of the present invention, a sample substrate (41) has a plurality of sample installation stages (42) in line in the longitudinal direction of a sample room (11).

In this way, as the sample substrate (41) comprises the sample installation stages (42) for loading a plurality kinds of sample stands (43), even if the sample stands vary by vacuum chamber, the carried samples can be used in new vacuum chambers.

In the desirable mode of the present invention, a sample room comprises a sample stand arrangement/transfer part and a fixed mechanism. The sample stand arrangement/transfer part comprises a mechanism for arranging a plurality kinds of sample stands (43) in piles. And the fixed mechanism comprises a mechanism for fixing the plurality kinds of sample stands (43) arranged in piles by the sample stand arrangement/transfer part. For example, the sample room is provided with a rail in the roof portion. And the sample stand arrangement/transfer part can move along with the rail. The sample stand arrangement/transfer part comprises an elevator mechanism (44). The elevator mechanism comprises two extendable arms, for example. And the ends of the two arms are provided with holding parts (45) which can move laterally. Otherwise, the ends of the two arms are provided with holding parts (45) which can move downward. And the elevator mechanism can move the holding parts from the roof to the sample stands. Likewise, the elevator mechanism can move the holding parts from the location of the sample stands to near the roof.

The way a certain sample stand A is loaded in other sample stand B is shown below. First, a sample arrangement/transfer part moves above the sample stand A. And the elevator mechanism of the sample stand arrangement/transfer part moves downward towards the sample stand A. The two arms of the elevator mechanism move to the side of the sample stand A. Then, the holding parts are put out from each of the two arms towards the sample stand A. The two holding parts hold the sample stand A. The elevator mechanism moves upward while holding the sample stand A. The sample stand arrangement/transfer part moves along the rail while holding the sample stand A. The sample stand arrangement/transfer part moves above the sample stand B. Then, the sample stand arrangement/transfer part moves the elevator mechanism downward towards the sample stand B. The elevator mechanism loads the sample stand A above the sample stand B. The elevator mechanism removes the holding parts from the sample stand A. And the elevator mechanism moves to near the roof.

FIG. 10(*c*) shows the fixed sample stands in piles. That is, the desirable mode of the present invention fixes the sample stands in piles. More specifically, after the elevator mechanism (44) loads the sample stand A above the sample stand B, the holding parts (45) should hold the sample stand A or the sample stand B. For example, the elevator mechanism which once moved to near the roof adjusts the interval between the two arms so that it is larger than the width of the sample stand A and it is narrower than the width of the sample stand B. In this state, the elevator mechanism moves downward towards the sample stand B. And the elevator mechanism falls to near the sample stand B. Then, the holding parts (45) are put out downward from the elevator mechanism. These holding parts force the sample stand B from above. In this way, the sample stand B can be fixed. By making the interval of the arms narrower than the width of the sample stand A, the sample stand A can be forced from above. Furthermore, the elevator mechanism itself may force the sample stand A or the sample stand B. In this way, the sample stands in piles can be fixed. In addition, the fixation mechanism may be used to fix each sample stand in addition to the sample stands in piles.

In this way, as sample stands can be located in piles, samples can be carried to a plurality kinds of vacuum chambers.

Figure 11A:
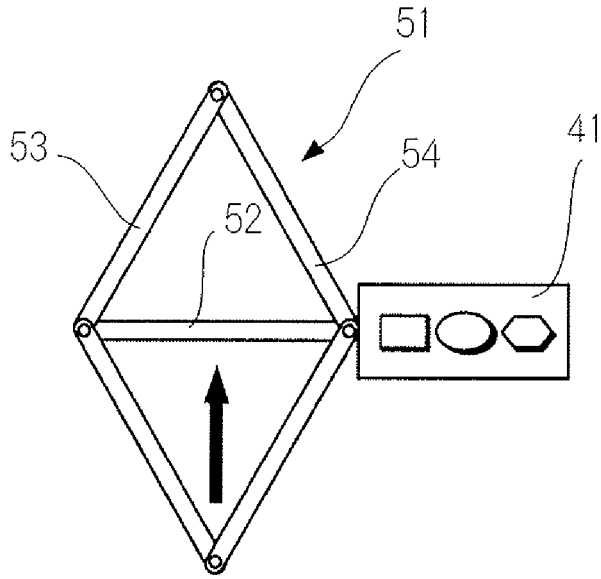
FIG. 11 shows an example of a movement mechanism.
Figure 11B:
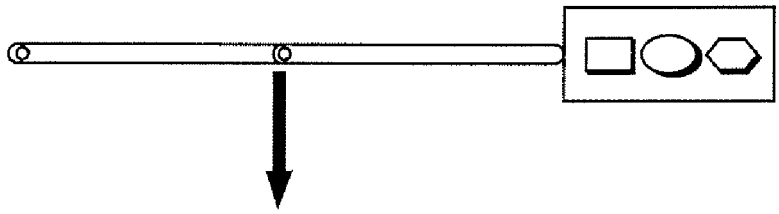

FIG. 11 shows an example of a movement mechanism. That is, in the desirable mode of the present invention, a sample room (11) comprises a driver mechanism (51) for driving a sample substrate (41). The drive mechanism is not particularly limited as far as it can move the sample substrate in a vacuum system. And the drive mechanism can move the sample substrate (41) from the inside to the outside of the sample room (11). Furthermore, the drive mechanism can move the sample substrate (41) from the outside to the inside of the sample room (11) as well.

In the drive mechanism shown in FIG. 11, an extendable movement axis (52) is attached to the sample substrate (41). FIG. 11(*a*) shows the situation of a shortened movement axis, whereas FIG. 11(*b*) shows the situation of an extended movement axis. The movement axis (52) itself, as a drive mechanism, may be driven by a certain actuator. In such a case, the sample stand can be moved by instructing the actuator to extend the movement axis. Moreover, as shown in FIG. 11, the bent legs (53, 54) may be provided centering on the movement axis (52). By extending these legs (53, 54), the movement axis (52) can be extended. Thereby, the sample substrate (41) can be moved. Furthermore, as a drive mechanism (51) different from the above, a magnet coupling drive mechanism is desirable. Well-known magnet coupling drive mechanisms can be employed suitably.

Figure 12:
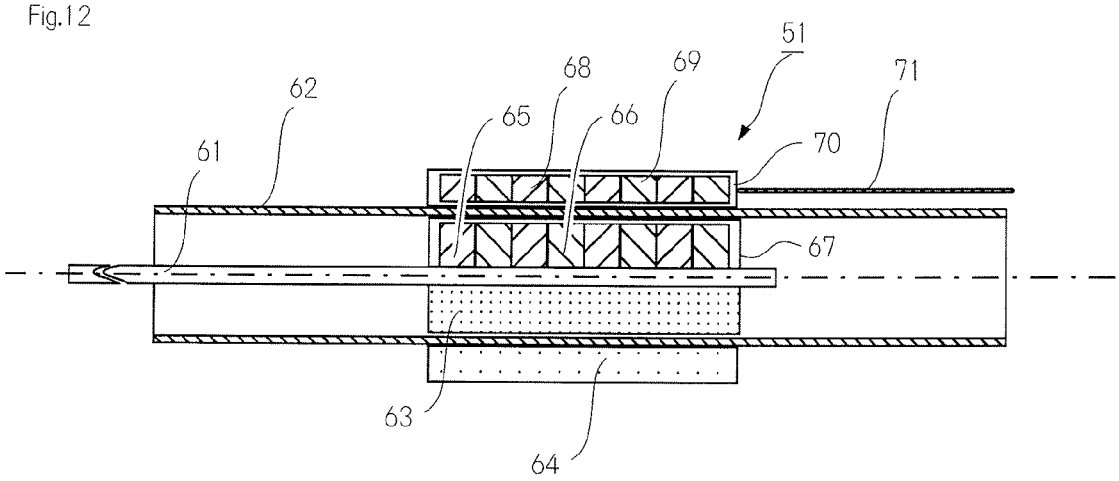
FIG. 12 shows an example of a magnet coupling drive mechanism.

FIG. 12 shows an example of a magnet coupling drive mechanism. This drive mechanism (51) comprises a rod (61), a tube (62), an internal moving body (63), and an external moving body (64). And the rod (61) is connected with a sample substrate (41) so that power can be transmitted to the sample substrate (41). The rod (61) may be directly connected with the sample substrate. Alternatively, the rod (61) may be connected with the sample substrate through an axis. As shown in FIG. 12, the internal moving body (63) has a main part (67) with magnets (65) and yokes (66) laminated alternately. The external diameter of the internal moving body is slightly smaller than the inner radius of the tube. In contrast, the external moving body (64) has a main part (70) with magnets (68) and yokes (69) laminated alternately. The inner radius of the external moving body is slightly larger than the external diameter of the tube. The external moving body is connected with an actuator (71). And when the actuator (71) receives a drive signal, the external moving body (64) moves along the circumferential side of the tube. Then, the internal moving body (63) also moves. When the internal moving body (63) moves, then the rod moves. When the rod moves, then the sample substrate moves. In this way, by driving the actuator (71), the sample substrate can be moved.

Figure 13:
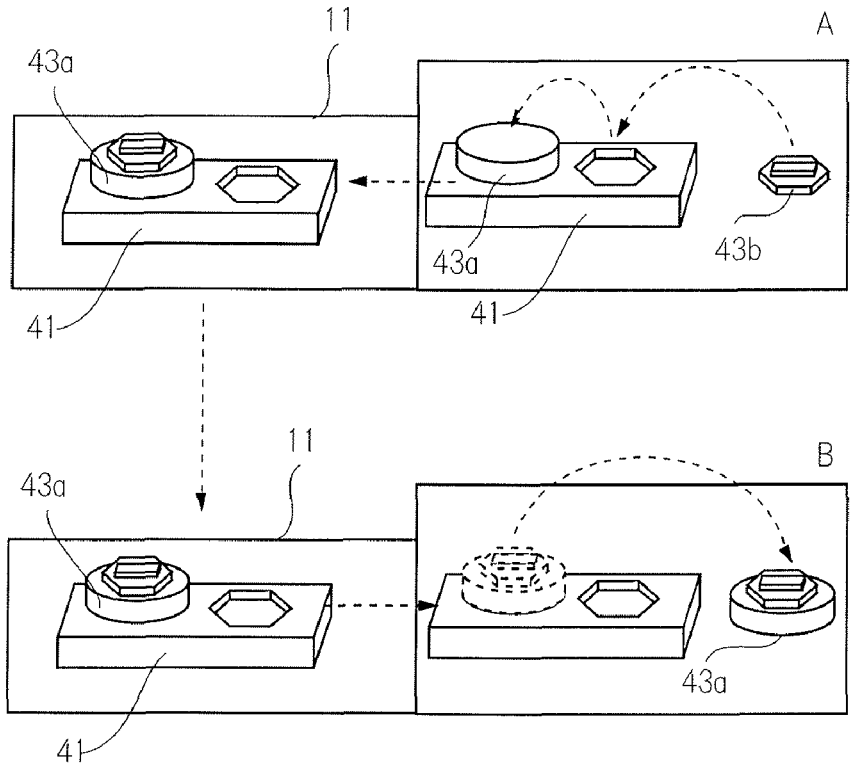
FIG. 13 shows a conceptual diagram for explaining the steps of carrying samples using a sample substrate.

FIG. 13 shows a conceptual diagram for explaining the steps of carrying samples using a sample substrate. FIG. 13 shows an example where the samples processed by a vacuum chamber A are delivered to another vacuum chamber B. The sample stand (43*b*) used in the vacuum chamber A and the sample stand (43*a*) used in the vacuum chamber B are different.

The gate valve of the sample room (11) is opened and the vacuum chamber A and the sample room (11) are located under the same atmosphere. Alternatively, the gate valve may be closed and the vacuum chamber A and the sample room (11) may be in different vacuum systems.

Predetermined processes are made for samples on the sample stand (43*b*) in the vacuum chamber A. The samples, with the sample stand (43*b*), are delivered to the sample installation stage (42) of the sample substrate (41) in the vacuum chamber A. The sample installation stage (42) at the time is fitted with the sample stand (43*b*), and the sample stand is fixed while transporting the vacuum carrying system to other location. Then, samples are loaded on another sample stand (43*a*) with the sample stand (43*b*).

When the gate valve of the sample room (11) is closed, the gate valve is opened. And the sample substrate (41) is moved to the sample room (11). Then, the gate valve of the sample room (11) is closed. Then, the vacuum chamber A and the sample room (11) are separated from each other. The separated sample room (11) is stored in a storage case maintaining a vacuum by an ion pump and transported to another location where the chamber B is located.

After the inside of the chamber B is put in a ultrahigh vacuum state, the sample room (11) and the vacuum chamber B are connected. Then, the gate valve of the sample room (11) is opened. Thereby, the sample (11) and the vacuum chamber B are opened/connected with each other. And the sample substrate (41) is transferred into the vacuum chamber B. Then, the sample stand (43*a*) is transferred from the sample substrate (41) and the samples on the sample stand (43*a*) are processed suitably.

3. Storage Case

Figure 14:
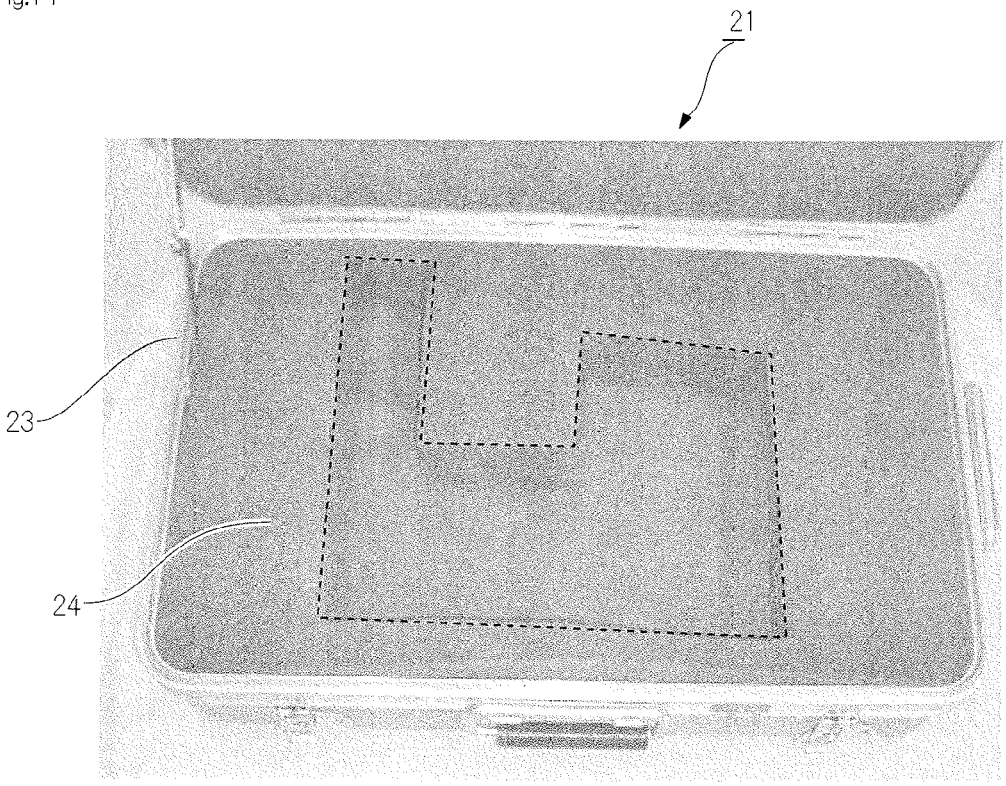
FIG. 14 shows a photograph replacing a drawing showing an example of a storage case.

FIG. 14 shows a photograph replacing a drawing showing an example of a storage case. As shown in FIG. 14, the storage case (21) comprises a frame of the storage case (23), and a storage part (24) which is provided inside the frame and provided with voids equivalent to the shapes of the sample room and the ion pump, and can locate in the voids the sample room and the ion pump.

Frame of a Storage Case (23)

Well-known frames can be employed suitably as a frame of a storage case (23). As it is desirable that the vacuum carrying system of the present invention can be used in a long-distance transportation by air etc., the frame is to be made of aluminum, duralumin, etc. Preferably, the frame is large enough to be carried as baggage on an airplane.

Storage Part

The storage part is not particularly limited as far as it is provided with voids equivalent to the shapes of the sample room and the ion pump and can locate in the voids the sample room and the ion pump.

Embodiment 1

Figure 15:
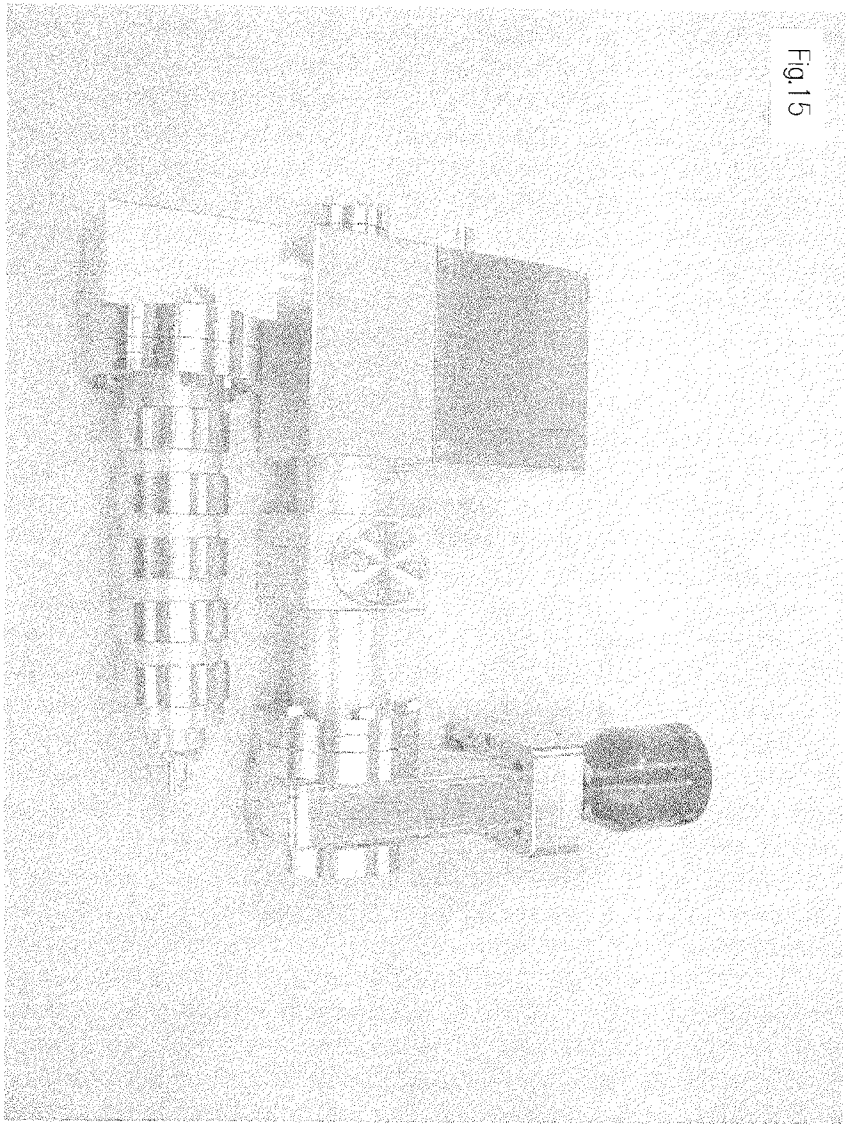
FIG. 15 shows a photograph replacing a drawing showing a vacuum carrying device of the present invention.

The prototypes of the ion pump and the vacuum carrying device concerning the present invention were manufactured. FIG. 15 is a photograph replacing a drawing showing a vacuum carrying device of the present invention.

In this ion pump, five ring-like permanent magnets are located at equal intervals in the circumference of the casing which concurrently serves as the negative electrode. In this vacuum carrying device, the frame was formed with aluminum having aluminum oxide film. Moreover, in another vacuum carrying device, the frame was formed with titanium having titanium oxide film. A 2.75" gate valve having a 1.42" routing port was used as a gate valve. An up-and-down clamp having a bellow was used as a sample lock. Batteries were used as a power supply. Moreover, a vacuum meter was placed for measuring the degree of vacuum in the sample room This vacuum carrying device could locate samples with a maximum diameter of 35 mm. Moreover, high vacuum with internal pressure of $1\times10^{-6}$ Pa or less could be attained. Continuous operation for fifteen hours could be maintained while maintaining the vacuum continuously. The total weight was about 10 kg.

Figure 16:
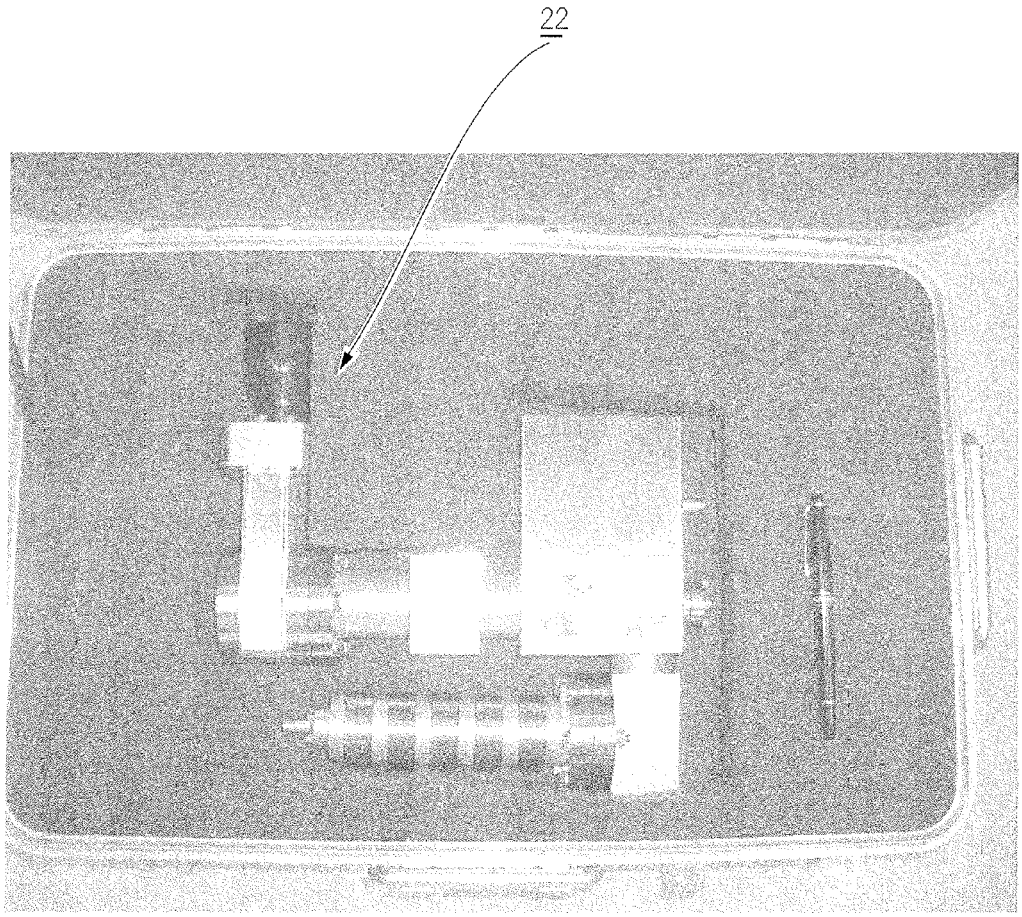
FIG. 16 shows a photograph replacing a drawing showing a vacuum carrying device stored in a storage case.

FIG. 16 shows a photograph replacing a drawing showing a vacuum carrying device stored in a storage case. As shown in FIG. 16, a storage case comprises voids equivalent to the shapes of the sample room and the ion pump, which can store the sample room and the ion pump therein, and can reduce vibration during transportation as well. A means to prevent vibration may be used suitably—one of such means is to locate a shock-absorbing gel layer in the storage part and surround the void parts.

Figure 17:
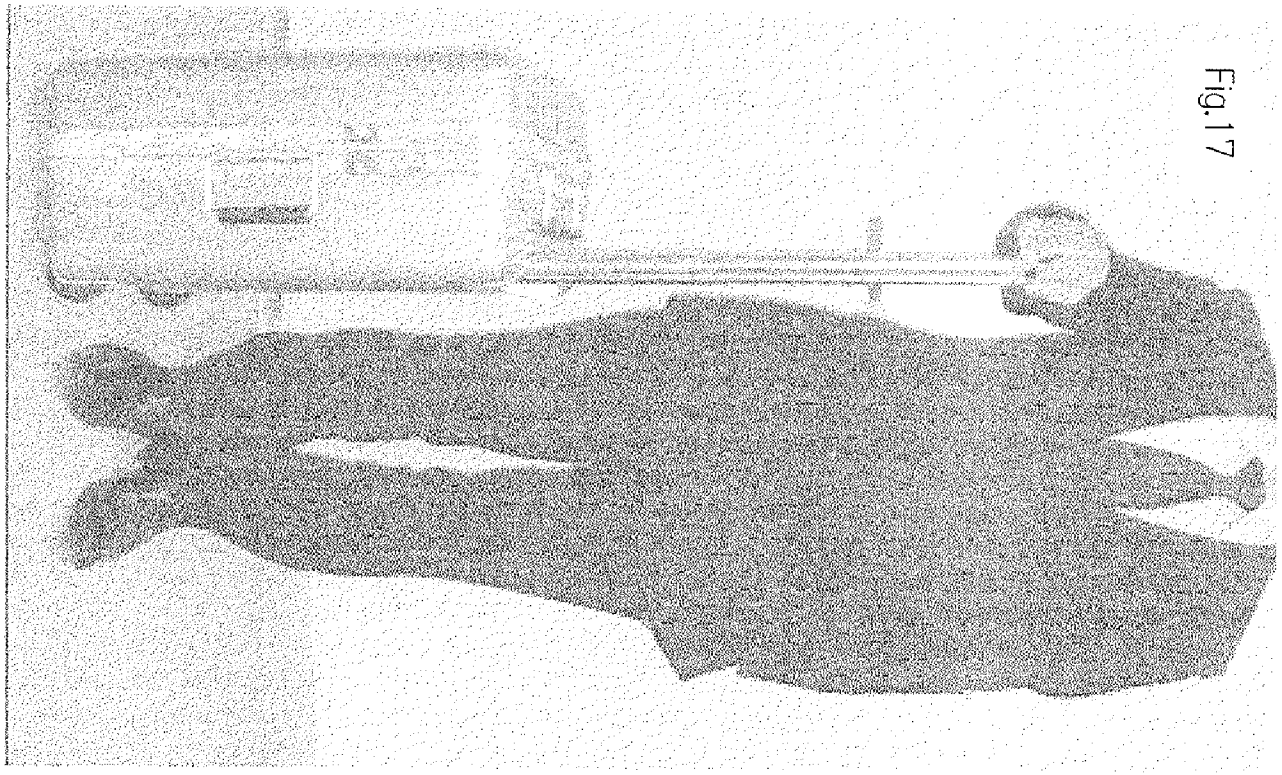
FIG. 17 shows a photograph replacing a drawing showing how a vacuum carrying system concerning an embodiment is actually carried.

FIG. 17 shows a photograph replacing a drawing showing how a vacuum carrying system concerning an embodiment is actually carried. As shown in FIG. 17, a vacuum carrying system having weight and size enough to be carried as baggage could be attained.

INDUSTRIAL APPLICABILITY

As the ion pump and the vacuum carrying device of the present invention are miniaturized and lightweight, they can be used suitably in the vacuum process industry.

As the vacuum carrying system of the present invention can carry experimental samples, samples, etc. while maintaining a vacuum state, it can also be used suitably in the transportation industry.

The invention claimed is:

1. A vacuum carrying system (22) comprising a sample room (11) for storing samples and an ion pump (6) for vacuumizing the inside of the sample room, which can be carried while the ion pump (6) is in operation, wherein the sample room (11) is connected with the ion pump (6), wherein the ion pump (6) comprises: a casing (1); a first electrode (2) provided inside the casing (1); a plurality of cylindrical magnets (4) fixed to the casing (1), a second electrode (3) arranged between the first electrode (2) and the plurality of cylindrical magnets, which has a different polarity from that of the first electrode (2); and a connection part (5) for connecting the casing (1) with other devices, wherein the plurality of cylindrical magnets are configured so that surfaces of adjacent magnets of the plurality of cylindrical magnets have the same polarities, wherein each of the surfaces of the adjacent magnets are North pole or South pole.

2. The vacuum carrying system (22) as claimed in claim 1, further comprising a storage case (21) for storing the sample mom (11) and the ion pump (6), wherein the storage case (21) comprises:

a frame of the storage case (23); and a storage part (24) provided inside the frame, comprising voids equivalent to the shapes of the sample room and the ion pump where the sample room and the ion pump can be located.

3. The vacuum carrying system (22) as claimed in claim 1, wherein the plurality of cylindrical magnets are located so as to surround the circumference of the second electrode (3) and located in a row at intervals in the central axis direction of the casing (1).

4. The vacuum carrying system (22) as claimed in claim 3, further comprising a movement mechanism (14) for moving the plurality of cylindrical magnets, which moves the plurality of cylindrical magnets in the longitudinal direction of the casing (1).

5. The vacuum carrying system (22) as claimed in claim 4, wherein the plurality of cylindrical magnets (4) can be removed from the casing (1).

6. The vacuum carrying system (22) as claimed in claim 3, comprising magnetic materials further having magnetic flux rectification effects between the adjacent magnets of the plurality of cylindrical magnets, wherein the magnetic materials are arranged so that magnetic fields, formed by the adjacent magnets and going from the adjacent surfaces into the central axis direction of the casing (1), may be stronger.

7. The vacuum carrying system (22) as claimed in claim 3, wherein the casing (1) concurrently serves as the second electrode (3).

8. The vacuum carrying system (22) as claimed in claim 3, wherein the casing is made of aluminum with titanium evaporated on the surface and serves as the second electrode (3).

9. The vacuum carrying system (22) as claimed in claim 3, wherein: the casing (1) is cylindrical; the first electrode (1) is a rod-like electrode located on the central axis of the casing or a cylindrical electrode located concentrically to the casing (1); the second electrode (3) is a cylindrical electrode located concentrically to the casing; and the plurality of cylindrical magnets (4) are located concentrically to the casing (I).

10. The vacuum carrying system (22) as claimed in claim 3, wherein one end of the first electrode (2) is fixed to the casing (1).

11. The vacuum carrying system (22) as claimed in claim 3, wherein one end of the first electrode (2) is fixed to the casing (1), and a spacer (8) for fixing the first electrode (2) to the casing (1) is provided in the region opposite to the one end fixed to the casing (1).

12. The vacuum carrying system (22) as claimed in claim 1, wherein the sample room (11) comprises a sample substrate (41) for loading samples, wherein the sample substrate (41) has a plurality of sample installation stages (42) in line in the longitudinal direction of the sample room (11) for loading a plurality of kinds of sample stands (43).

13. The vacuum carrying system (22) as claimed in claim 1, wherein the sample room (11) comprises a sample stand arrangement/transfer part (46) for arranging a plurality of kinds of sample stands (43) in piles, and a fixation mechanism (47) for fixing the plurality of sample stands (43) arranged in piles by the sample stand arrangement/transfer part.

14. The vacuum carrying system (22) as claimed in claim 1, wherein the sample room (11) has a drive mechanism (51) for driving the sample substrate (41) for loading samples, which can move the sample substrate (41) from the inside to the outside of the sample room (11) as well as move the sample substrate (41) from the outside to the inside of the sample room (11).

15. The system as claimed in claim 14, wherein the device mechanism (51) is a magnet coupling drive mechanism.

16. The vacuum carrying system (22) as claimed in claim 1, wherein the sample room (11) comprises a sample stand arrangement/transfer part (46) for arranging a plurality kinds of sample stands (43) in piles on sample installation stages (42) for loading the plurality kinds of sample stands (43), and a fixation mechanism (47) for fixing the plurality of sample stands (43) arranged in piles on the sample installation stages (42) by the sample stand arrangement/transfer part.

17. A vacuum carrying system (22) comprising a sample room (11) for storing samples and an ion pump (6) for vacuumizing the inside of the sample room, which can be carried while the ion pump (6) is in operation, wherein the sample room (11) is connected with the ion pump (6), wherein the ion pump (6) comprises: a casing (1); a first electrode (2) provided inside the casing (1); a second electrode (3) fixed to the inner wall of the casing (1), which is located between the casing and the first electrode (2) and has a different polarity from that of the first electrode; a plurality of cylindrical magnets (4) located so as to surround the circumference of the second electrode (3); and a connection part (5) for connecting the casing (1) with other devices, wherein the plurality of cylindrical magnets are configured so that the surfaces of adjacent magnets of the plurality of cylindrical magnets have the same polarities, wherein each of the surfaces of the adjacent magnets are North pole or South pole.

* * * * *